US011163254B2

(12) United States Patent
Takaba et al.

(10) Patent No.: US 11,163,254 B2
(45) Date of Patent: Nov. 2, 2021

(54) IMAGE FORMING SYSTEM FOR EXECUTING STAPLING PROCESS

(71) Applicant: CANON KABUSHIKI KAISHA, Tokyo (JP)

(72) Inventors: Ryo Takaba, Odawara (JP); Seiji Yokoyama, Numazu (JP); Genki Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/688,959

(22) Filed: Nov. 19, 2019

(65) Prior Publication Data

US 2020/0174416 A1 Jun. 4, 2020

(30) Foreign Application Priority Data

Nov. 29, 2018 (JP) ..... JP2018-224156

(51) Int. Cl.

| | |
|---|---|
| ***B65H 37/04*** | (2006.01) |
| ***G03G 15/00*** | (2006.01) |
| ***B42C 1/12*** | (2006.01) |
| ***B65H 43/00*** | (2006.01) |

(52) U.S. Cl.

CPC ..... *G03G 15/6541* (2013.01); *B42C 1/12* (2013.01); *B65H 37/04* (2013.01); *B65H 43/00* (2013.01); *B65H 2511/51* (2013.01); *G03G 2215/0086* (2013.01); *G03G 2215/00864* (2013.01)

(58) Field of Classification Search

None

See application file for complete search history.

(56) References Cited

U.S. PATENT DOCUMENTS

| | | | | |
|---|---|---|---|---|
| 7,407,156 | B2 * | 8/2008 | Lizuka | B65H 31/24 270/58.11 |
| 8,226,079 | B2 * | 7/2012 | Ozawa | B65H 31/34 270/58.09 |
| 9,139,397 | B2 * | 9/2015 | Sato | B31F 5/00 |
| 9,296,586 | B2 * | 3/2016 | Hata | B65H 43/00 |

(Continued)

FOREIGN PATENT DOCUMENTS

| | | | |
|---|---|---|---|
| JP | H01-247372 | A | 10/1989 |
| JP | 2005-206298 | A | 8/2005 |
| JP | 2014-162590 | A | 9/2014 |

*Primary Examiner* — Leslie A Nicholson, III

(74) *Attorney, Agent, or Firm* — Canon U.S.A., Inc. I.P. Division

(57) ABSTRACT

An image forming system includes a processing tray, a detecting unit, a stapling unit, a discharge tray, an instruction unit, and a control unit. Recording material, placed on the processing tray, is detected by the detecting unit. When instructed, the stapling unit can staple the detected recording material. Stapled recording material then is discharged to the discharge tray. The control unit controls switching between a first mode wherein a stapling process is executed and a second mode where the stapling unit executes the stapling process after the detecting unit detects recording material inserted into the processing tray and the execution instruction are received. If an instruction to interrupt a power supply of the image forming system is received in the second mode, the control unit causes recording material inserted into the processing tray to discharge to the discharge tray and then interrupts the power supply without the stapling process executing.

10 Claims, 7 Drawing Sheets

(56) References Cited

U.S. PATENT DOCUMENTS

| | | | | |
|---|---|---|---|---|
| 9,454,121 | B2 * | 9/2016 | Hikichi | B65H 43/00 |
| 9,567,184 | B2 * | 2/2017 | Kanemaru | B65H 9/04 |
| 10,926,971 | B2 * | 2/2021 | Yokoyama | G03G 15/6544 |

* cited by examiner

IMAGE FORMING SYSTEM FOR EXECUTING STAPLING PROCESS

BACKGROUND

Field

The present disclosure relates to an image forming system including an image forming apparatus that executes image formation with respect to recording material and a postprocessing apparatus that executes a stapling process with respect to the recording material conveyed from the image forming apparatus.

Description of the Related Art

Some postprocessing apparatuses, which receive recording material discharged from an image forming apparatus such as a copier or a printer and execute postprocessing, execute a stapling process with respect to the received recording material (hereinafter, this function will be referred to as "automatic stapling"). Further, other postprocessing apparatuses execute a stapling process with respect to recording material inserted by a user from outside of a main body of the apparatus (hereinafter, this function will be referred to as "manual stapling").

Japanese Patent Laid-Open No. 2005-206298 discloses a postprocessing apparatus that achieves two functions with a single stapling unit, instead of individually including a stapling unit that performs automatic stapling and a stapling unit that performs manual stapling. In this postprocessing apparatus, when a user inserts recording material from a discharge port of the postprocessing apparatus into a processing tray that executes automatic stapling and presses an execution button for manual stapling, a stapling process is executed with respect to the inserted recording material.

However, in the postprocessing apparatus disclosed in Japanese Patent Laid-Open No. 2005-206298, in a case where the user inserts recording material from the discharge port of the postprocessing apparatus into the processing tray but interrupts a power supply of the apparatus instead of pressing the execution button for manual stapling, the recording material remains on the processing tray. As a result, occurrence of a sheet jam (paper jam) may be erroneously determined when the power supply is restored, and the user may perform unnecessary jam recovery. Also in a case where a door of the apparatus is opened/closed in a state in which the recording material is left on the processing tray, a similar issue arises.

SUMMARY

According to an aspect of the present disclosure, an image forming system includes an image forming unit configured to form an image on recording material, a processing tray on which the recording material, having an image formed on the recording material, is to be placed, a recording material detecting unit configured to detect the recording material placed on the processing tray, a stapling unit configured to execute a stapling process with respect to the recording material placed on the processing tray, a discharge unit configured to discharge, from the processing tray via a discharge port, the recording material subjected to the stapling process by the stapling unit, a discharge tray on which the recording material discharged by the discharge unit is received, an instruction unit configured to issue an execution instruction to instruct the stapling unit to execute the stapling process, and a control unit configured to control switching between a first mode and a second mode, wherein the first mode is a mode in which the stapling process is executed with respect to the recording material conveyed from the image forming unit to the processing tray, and the second mode is a mode in which the stapling unit stands by the execution instruction from the instruction unit in a state in which the recording material detecting unit detects the recording material inserted into the processing tray from outside of a main body of the recording material detecting unit via the discharge port and, upon receipt of the execution instruction, executes the stapling process, wherein, in a case where, in a state in which the recording material detecting unit detects the recording material inserted into the processing tray and the stapling unit stands by the execution instruction in the second mode, the control unit receives an interruption instruction to interrupt a power supply of the image forming system, the control unit, without causing the stapling unit to execute the stapling process with respect to the recording material inserted into the processing tray, causes the discharge unit to execute discharge operation for discharging the recording material inserted into the processing tray to the discharge tray, and then interrupts the power supply.

Further features of the present disclosure will become apparent from the following description of exemplary embodiments (with reference to the attached drawings).

DESCRIPTION OF THE EMBODIMENTS

Example 1

In this example, there will be described operation performed in a case where an interruption instruction to interrupt a power supply of an image forming system is issued in a state in which a bundle of paper for manual stapling remains on a processing tray.

Figure 1:
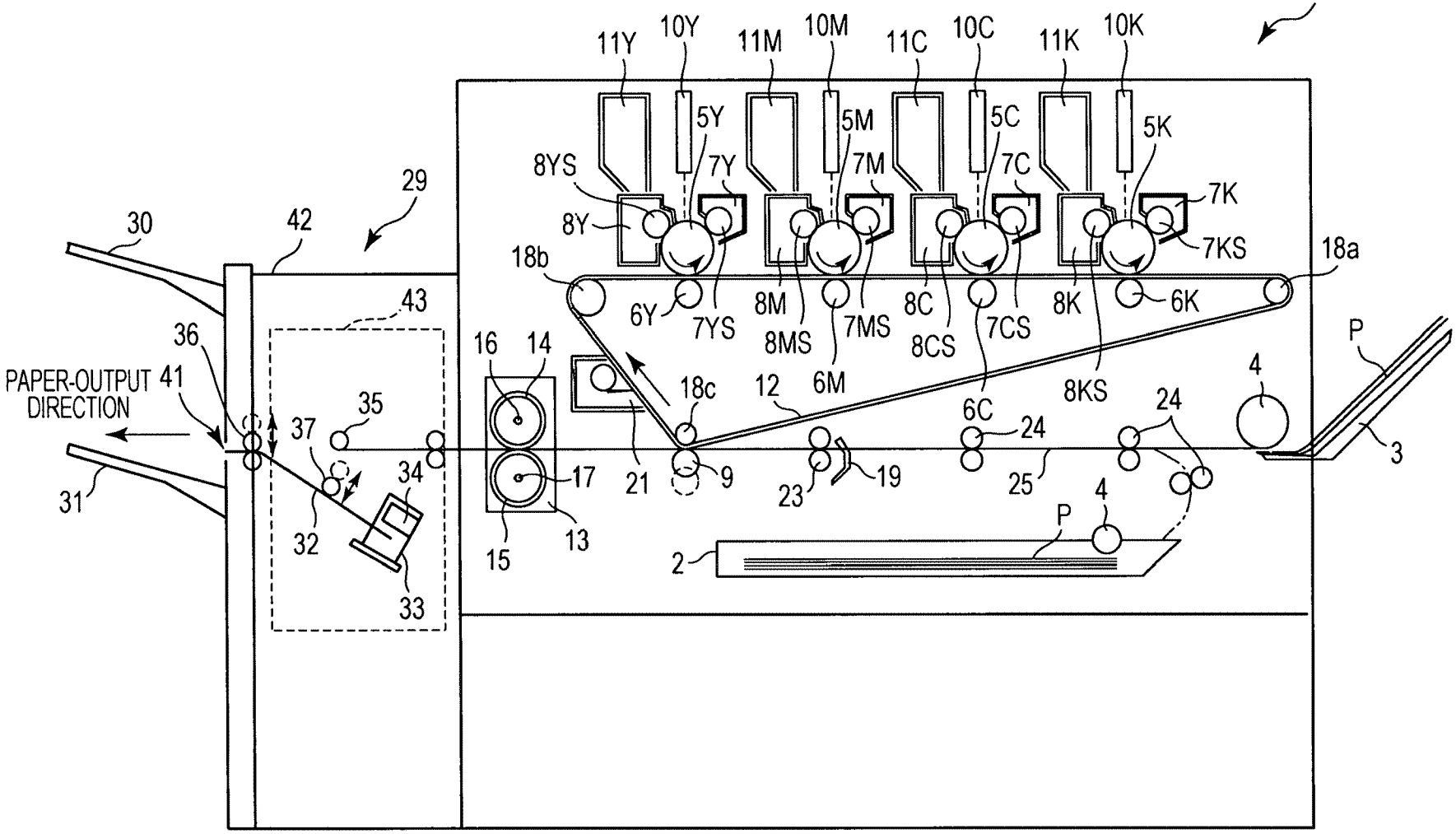
FIG. 1 shows a configuration of an image forming system.

FIG. 1 shows a configuration of an image forming system 1 including an image forming apparatus 101 and a postprocessing apparatus 29 in this example. The image forming apparatus 101 is an electrophotographic color laser beam printer. The image forming apparatus 101 includes photoconductor drums 5Y, 5M, 5C, and 5K for respective stations arranged side by side corresponding to the number of developing colors, each of the photoconductor drums 5Y, 5M, 5C, and 5K being formed by applying an organic photoconductive layer to an outer periphery of an aluminum cylinder. Herein, Y represents yellow, M represents magenta, C represents cyan, and K represents black. Hereinafter, individual colors will not be differentiated, unless it is necessary. The image forming apparatus 101 includes chargers 7, laser scanners 10, developing units 8, toner cartridges 11, an intermediate transfer belt 12, primary transfer rollers 6, a secondary transfer roller 9, and a fuser 13.

When printing operation is started, the photoconductor drums 5 are rotated by a drive motor (not shown) in a counterclockwise direction (direction indicated by arrows in FIG. 1). The chargers 7 include charging sleeves 7S (7YS, 7MS, 7CS, and 7KS) in order to charge the photoconductor drums 5. Surfaces of the photoconductor drums 5 charged by the charging sleeves 7S are exposed by the laser scanners 10. The laser scanners 10 expose the photoconductor drums 5 based on input image data and form electrostatic latent images on the photoconductor drums 5. The developing units 8 include developing sleeves 8S (8YS, 8MS, 8CS, and 8CK) in order to visualize the electrostatic latent images formed on the photoconductor drums 5. The developing sleeves 8S supply toners to the photoconductor drums 5, thereby visualizing the electrostatic latent images as toner images.

The intermediate transfer belt 12 is an endless belt stretched by a driving roller 18*a* and driven rollers 18*b* and 18*c*. The intermediate transfer belt 12 is rotated by the driving roller 18*a* in a clockwise direction (a direction indicated by an arrow in FIG. 1) while being in contact with the photoconductor drums 5. Then, the toner images are successively transferred to the intermediate transfer belt 12 by the primary transfer rollers 6 (hereinafter, referred to as "primary transfer"). The toner images of the respective colors are transferred to the intermediate transfer belt 12 while being superimposed on each other, and thus a color image is formed on the intermediate transfer belt 12.

A sheet P (recording material) is placed on a sheet feeding cassette 2 or a multi-tray 3. A sheet feeding roller 4 feeds the sheet P to a conveying path 25 from the sheet feeding cassette 2 or the multi-tray 3. The sheet P fed to the conveying path 25 is conveyed by conveying rollers 24 to a registration sensor 19. When the registration sensor 19 detects a front edge of the sheet P, the sheet P is further conveyed in a certain amount and is caused to abut against stopped registration rollers 23. With this, the sheet P is bent (also referred to as "looped"). The registration rollers 23 convey the stopped sheet P to the secondary transfer roller 9 again so that a timing of the sheet P matches a timing of the toner images formed on the intermediate transfer belt 12. The sheet P is conveyed while being sandwiched between the intermediate transfer belt 12 and the secondary transfer roller 9, and the toner images formed on the intermediate transfer belt 12 are collectively transferred to the sheet P (hereinafter, referred to as "secondary transfer"). In a case where secondary transfer is performed, the secondary transfer roller 9 is moved to a position indicated by a solid line and is brought into contact with the intermediate transfer belt 12. Meanwhile, in a case where secondary transfer is not performed, the secondary transfer roller 9 is moved to a position indicated by a dotted line and is separated from the intermediate transfer belt 12.

The fuser 13 fuses the transferred toner images to the sheet P while conveying the sheet P. The fuser 13 includes a fusing roller 14 that heats the sheet P and a pressure roller 15 that brings the sheet P into pressure contact with the fusing roller 14. The fusing roller 14 and the pressure roller 15 are formed to have a hollow shape and include heaters 16 and 17, respectively. The cleaning device. 21 cleans toners remaining on the intermediate transfer belt 12. The cleaned toners are stored in a cleaner container included in the cleaning device 21.

The postprocessing apparatus 29 receives sheets P output from the image forming apparatus 101 and executes a postprocess with respect to the received sheets P. For example, the postprocessing apparatus 29 has a function of sorting received sheets P into a plurality of paper-output trays 30 and 31 (discharge trays) and a function of executing a stapling process (binding process) to bind the plurality of sheets P. In a case where the sheets P are sorted into the paper-output trays 30 and 31, the paper-output trays 30 and 31 are vertically moved by a motor (not shown) for raising/lowering the paper-output trays 30 and 31.

A configuration regarding a stapling process will be described in detail. A stapling unit 33 executes a stapling process with respect to a plurality of sheets P stacked on a stapling tray 32 (processing tray). Further, the stapling unit 33 includes a staple cartridge 34. The staple cartridge 34 includes staples for use in the stapling process.

There will be described a case where a stapling process is executed with respect to the sheets P output from the image forming apparatus 101. When a rear edge of the sheet P conveyed from the image forming apparatus 101 to the postprocessing apparatus 29 passes through a conveying roller pair 35 and reaches a paper-output roller pair 36, the paper-output roller pair 36 and a drawing roller 37 are reversely rotated, thereby drawing the sheet P into the stapling tray 32 and stacking the sheet P thereon. After the number of sheets P specified in advance is stacked on the stapling tray 32, a stapling process is executed by the stapling unit 33. A bundle of the sheets P subjected to the stapling process is output to the paper-output tray 30 or the paper-output tray 31 by the paper-output roller pair 36 via a paper-output port 41 (discharge port) formed in an apparatus main body 42. Hereinafter, this function will be referred to as "automatic stapling".

Further, a door 43 is provided in the postprocessing apparatus 29 in preparation for a case where a sheet jam (paper jam) occurs while the sheets P are being conveyed or subjected to a postprocess. In a case where a sheet jam occurs, a user opens the door 43 and accesses inside of the main body of the postprocessing apparatus 29, thereby removing the jammed sheet P.

Next, a case where a stapling process is performed on a bundle of paper inserted by the user from outside of the apparatus main body 42 will be described with reference to FIGS. 1 and 2. Hereinafter, this function will be referred to as "manual stapling".

Figure 2:
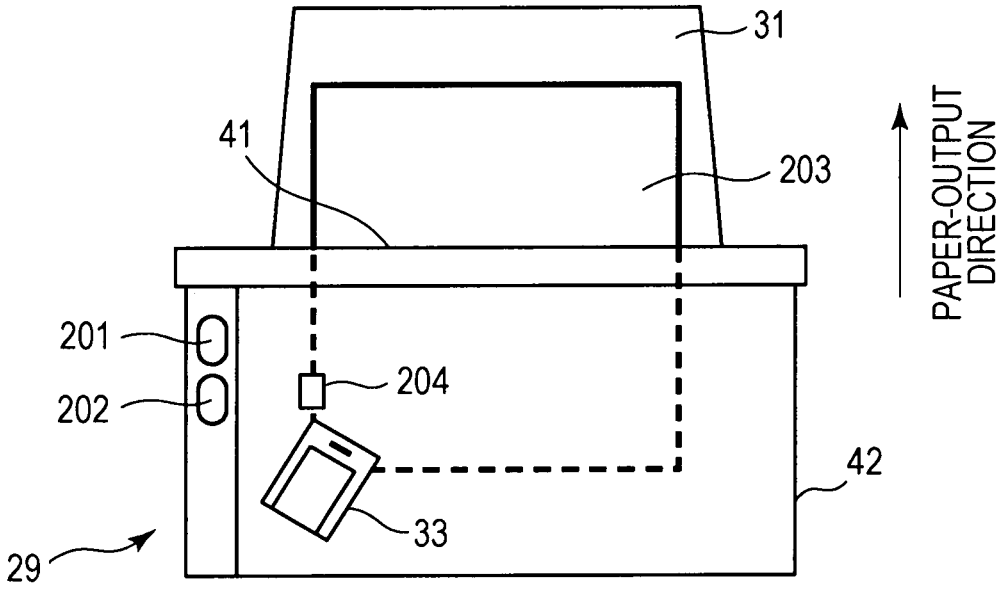
FIG. 2 is a bird's-eye view of a postprocessing apparatus.

FIG. 2 is a bird's-eye view of the postprocessing apparatus 29 in this example. A manual stapling mode transition button 201 and a manual stapling execution button 202 are provided in the postprocessing apparatus 29 (hereinafter, referred to as "transition button 201" and "execution button 202", respectively). Further, the postprocessing apparatus 29 includes a sheet detection sensor 204 (recording material detecting unit) that detects a bundle of paper 203 inserted into the stapling tray 32. The postprocessing apparatus 29 in this example is configured so that manual stapling is executed when the user inserts the bundle of paper 203 into the stapling tray 32 via the paper-output port 41. Herein, the paper-output port 41 is an opening through which a bundle of paper subjected to a stapling process in automatic stapling passes when the bundle of paper is output to the paper-output tray 30 or 31.

In a case where manual stapling is executed, the postprocessing apparatus 29 moves the paper-output roller pair 36 and the drawing roller 37 in FIG. 1 to positions indicated by dotted lines in response to a press of the transition button 201 by the user. With this, the paper-output roller pair 36 and the drawing roller 37 do not hinder insertion of the bundle of paper 203 by the user. The bundle of paper 203 inserted from the outside of the apparatus main body 42 via the paper-output port 41 is detected by the sheet detection sensor 204. When the sheet detection sensor 204 detects the bundle of paper 203, the postprocessing apparatus 29 becomes a manual stapling execution standby state. Then, when the execution button 202 is pressed by the user, an instruction to execute a stapling process is issued, and the postprocessing apparatus 29 performs a stapling process by using the stapling unit 33. After the manual stapling process is terminated, the postprocessing apparatus 29 moves the paper-output roller pair 36 and the drawing roller 37 in FIG. 1 to positions indicated by solid lines and normally rotates the paper-output roller pair 36 and the drawing roller 37, thereby outputting the bundle of paper 203 to the paper-output tray 30 or 31. As described above, the paper-output roller pair 36 and the drawing roller 37 are configured to be movable between the positions indicated by the solid lines and the positions indicated by the dotted lines.

Figure 3:
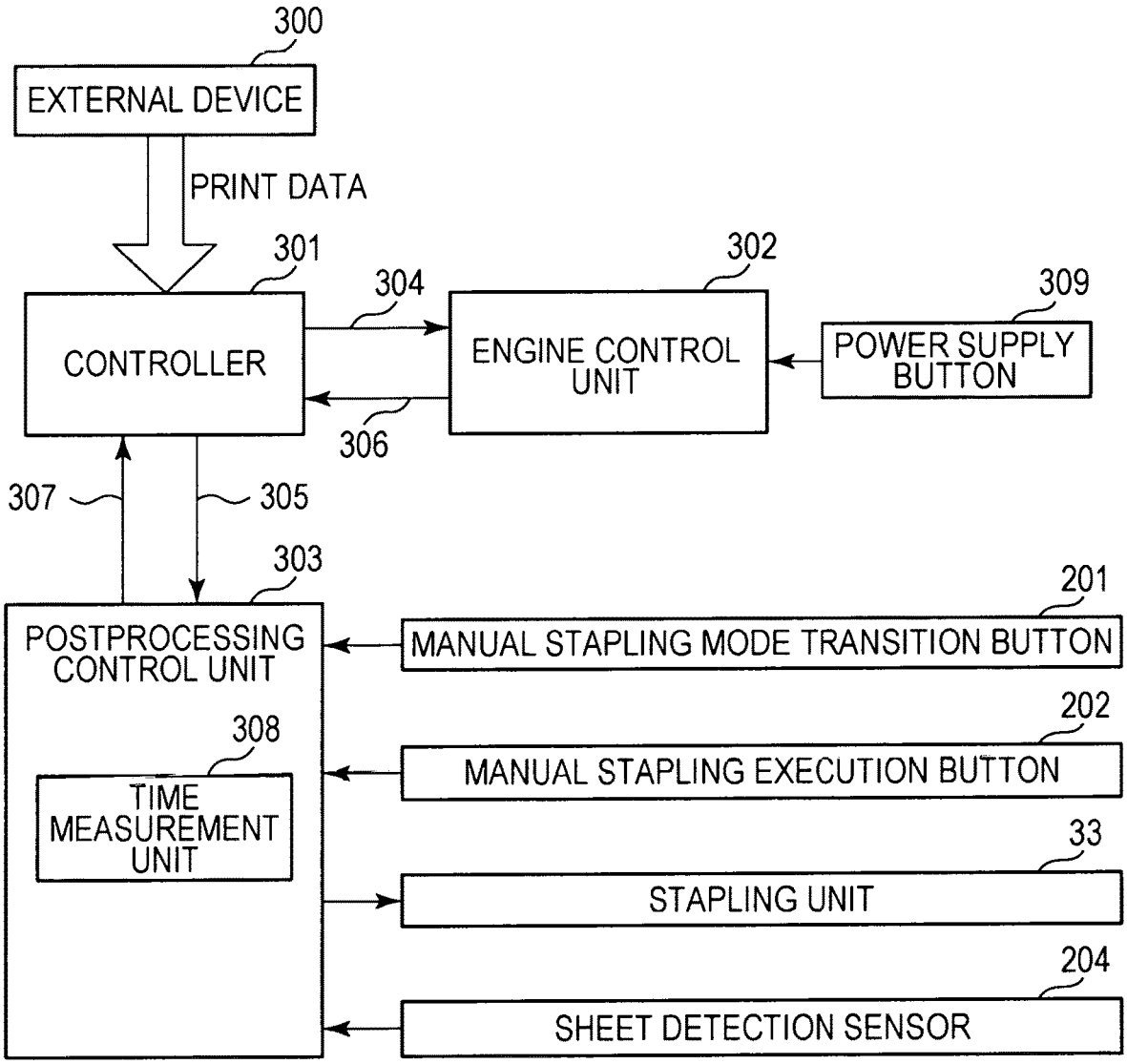
FIG. 3 is a control block diagram of an image forming system in Example 1.

FIG. 3 is a block diagram of a system configuration of the image forming apparatus 101 and the postprocessing apparatus 29 in this example. A controller 301 communicates with an external device 300 such as a host computer and receives print data. Further, the controller 301 integrally controls the image forming apparatus 101 and the postprocessing apparatus 29. An engine control unit 302 controls the image forming apparatus 101, and a postprocessing control unit 303 controls the postprocessing apparatus 29. A serial signal line 304 transmits a command signal from the controller 301 to the engine control unit 302, and a serial signal line 305 transmits a command signal from the controller 301 to the postprocessing control unit 303. A serial signal line 306 transmits status data from the engine control unit 302 to the controller 301 in response to the command signal, and a serial signal line 307 transmits status data from the postprocessing control unit 303 to the controller 301 in response to the command signal. The controller 301 performs control by transmitting command signals to the engine control unit 302 and the postprocessing control unit 303 and receiving status data from the engine control unit 302 and the postprocessing control unit 303. As described above, in a case where a plurality of apparatuses operates while being connected to each other, the controller 301 unitarily manages control and a state of each apparatus and maintains consistency of operation between the apparatuses. Note that the controller 301 and the engine control unit 302 are provided in the image forming apparatus 101, and the postprocessing control unit 303 is provided in the postprocessing apparatus 29.

The postprocessing control unit 303 conveys a sheet in response to a command signal from the controller 301. Further, the postprocessing control unit 303 can perform control while switching between automatic stapling and manual stapling. Furthermore, in a case where automatic stapling is performed, the postprocessing control unit 303 controls the stapling unit 33 and performs a stapling process on a bundle of the sheets P output from the image forming apparatus 101. Still further, in a case where manual stapling is performed, the postprocessing control unit 303 controls the stapling unit 33 and performs a stapling process on the basis of input signals of the transition button 201, the execution button 202, and the sheet detection sensor 204. Moreover, the postprocessing control unit 303 includes a time measurement unit 308. The time measurement unit 308 measures time elapsed from detection of the sheet P by the sheet detection sensor 204.

A power supply button 309 of the image forming apparatus 101 is connected to the engine control unit 302. When the user presses the power supply button 309, a power supply of the image forming apparatus 101 is switched on or off. A power supply of the postprocessing apparatus 29 is also switched on or off in accordance with on or off of the power supply of the image forming apparatus 101. That is, the power supply of the image forming system is switched on or off. When the power supply button 309 is pressed, information indicating that the power supply button 309 has been pressed is transmitted from the engine control unit 302 to the controller 301 and is further transmitted from the controller 301 to the postprocessing control unit 303.

Figure 4:
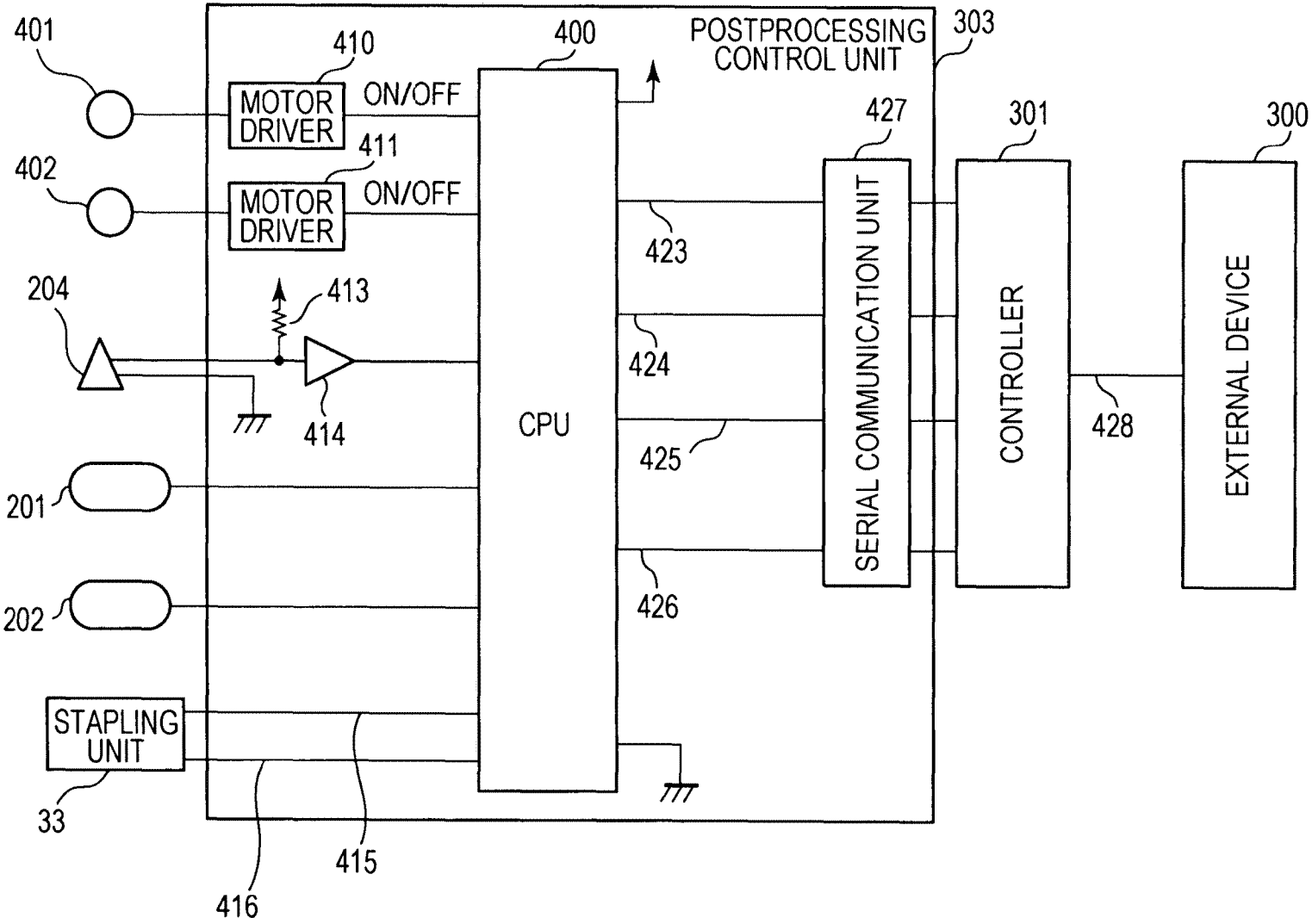
FIG. 4 is a detailed view of a postprocessing control unit.

FIG. 4 is a detailed view of the postprocessing control unit 303 in this example. The postprocessing control unit 303 includes a CPU 400 and communicates with the controller 301 via a serial communication unit 427. The serial communication unit 427 connects the CPU 400 and the controller 301 with a plurality of signal lines including the serial signal lines 305 and 307. When print data 428 is transmitted to the controller 301 via the external device 300, the controller 301 transmits a paper-output operation start signal 423, a suspended operation presence/absence signal 424, and the like to the CPU 400 via the serial communication unit 427. Herein, the paper-output operation start signal 423 is a signal indicating a timing at which the sheet P is conveyed from the image forming apparatus 101 to the postprocessing apparatus 29. The suspended operation presence/absence signal 424 is a signal indicating that, in a case where a new print instruction is transmitted from the external device 300 in a manual stapling mode, a process of the print data 428 corresponding to the print instruction is suspended. Further, the CPU 400 transmits a paper-output operation status signal 425, a mode transition signal 426, and the like to the controller 301 via the serial communication-unit 427. Herein, the paper-output operation status signal 425 is a signal indicating a processing status of the sheet P inside the postprocessing apparatus 29. The mode transition signal 426 is a signal indicating release of the manual stapling mode.

Motor drivers 410 and 411 are connected to an output terminal of the CPU 400. The motor driver 410 drives a paper-output motor 401. By normally rotating or reversely rotating the paper-output motor 401, it is possible to normally rotate or reversely rotate the paper-output roller pair 36 and the drawing roller 37. By normally rotating the paper-output roller pair 36 and the drawing roller 37, it is possible to output the sheet P to the paper-output tray 30 or 31. By reversely rotating the paper-output roller pair 36 and the drawing roller 37, it is possible to draw the sheet P into the stapling tray 32. The motor driver 411 drives a separating motor 402. By normally rotating or reversely rotating the separating motor 402, it is possible to move the paper-output roller pair 36 and the drawing roller 37 to a contact position or a separated position. The contact position is a position at which the paper-output roller pair 36 and the drawing roller 37 are brought into contact with the sheet P placed on the stapling tray 32, and the separated position is a position at which the paper-output roller pair 36 and the drawing roller 37 are separated from the sheet P placed on the stapling tray 32. The sheet detection sensor 204 inputs a sensor status (ON signal or OFF signal) to the CPU 400 via a buffer 414 by using a pull-up 413. The transition button 201 and the execution button 202 input a pressing state (ON signal or OFF signal) of the buttons to the CPU 400. Further, a stapling motor drive signal 415 of the stapling unit 33 is connected to the output terminal of the CPU 400, and a home position sensor signal 416 of the stapling unit 33 is connected to an input terminal of the CPU 400. Herein, the home position sensor signal 416 is a signal indicating whether or not a stapler is positioned at a home position. In a case where stapling operation is performed, the CPU 400 drives a stapling motor in the stapling unit 33 via the stapling motor drive signal 415 and performs a stapling process. Then, the CPU 400 stops the stapling motor via the stapling motor drive signal 415 in response to an input value of the home position sensor signal 416.

Figure 5:
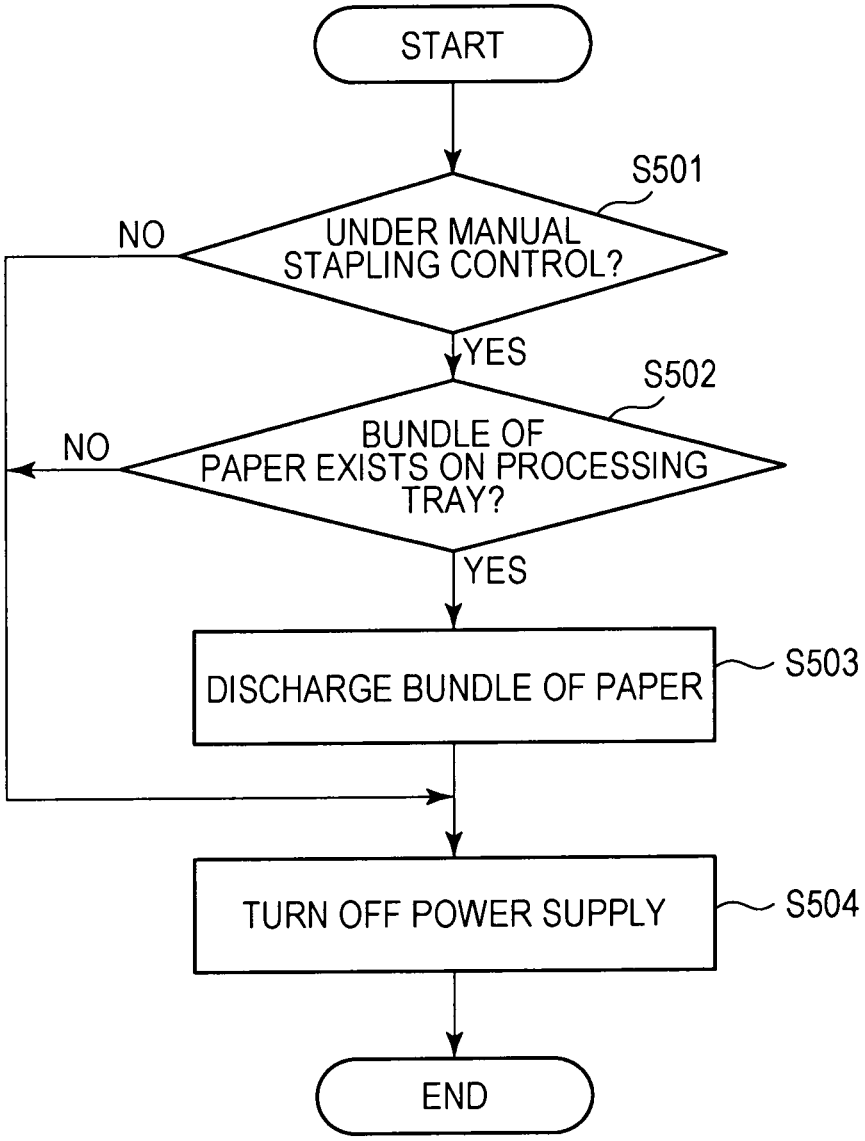
FIG. 5 is a flowchart showing operation of a postprocessing control unit in Example 1.

Hereinabove, in the configuration described above, operation of the postprocessing apparatus 29 in this example will be described with reference to a flowchart of FIG. 5. A start timing of this flow is a timing at which the postprocessing control unit 303 receives an interruption instruction to interrupt the power supply from the controller 301 due to cause such as a press of the power supply button 309 by the user. Note that control based on FIG. 5 is mainly executed by the CPU 400 included in the postprocessing control unit 303 on the basis of a program stored on a ROM or the like (not shown).

First, the postprocessing control unit 303 checks whether or not the postprocessing control unit 303 itself is under manual stapling control (S501). The postprocessing control unit 303 determines a period from a press of the transition button 201 to a press of the execution button 202 as "under manual stapling control". After the execution button 202 is pressed and a stapling process is actually started by the stapling unit 33, the stapling process is not stopped due to a factor other than emergency stop, and thus a period after the execution button 202 is pressed is not included in the period of "under manual stapling control" of this time.

In S501, in a case where the postprocessing control unit 303 determines that the postprocessing control unit 303 is not under the manual stapling control, the postprocessing control unit 303 implements a power-supply off process (S504). In S501, in a case where the postprocessing control unit 303 determines that the postprocessing control unit 303 is under the manual stapling control, the postprocessing control unit 303 checks whether or not the sheet P is stacked on the stapling tray 32 on the basis of information of the sheet detection sensor 204 (S502). In a case where the sheet P is not stacked on the stapling tray 32, the postprocessing control unit 303 implements the power-supply off process (S504). In a case where the sheet P is stacked, the postprocessing control unit 303 determines that a dischargeable bundle of paper is stacked and implements discharge operation of the bundle of paper (S503). Thereafter, the postprocessing control unit 303 implements the power-supply off process (S504) and terminates the flow.

As described above, the sheet P placed on the stapling tray 32 is output to the paper-output tray 30 or 31 in advance before the power supply is interrupted. This prevents the sheet detection sensor 204 from detecting the sheet P when the power supply is restored again. As a result, the postprocessing control unit 303 does not wrongly detect a sheet jam.

Further, the following control is also considered: by providing a non-volatile memory in the postprocessing control unit 303 and storing a state before the power supply is switched off, the postprocessing control unit 303 does not determine a sheet jam even if the sheet detection sensor 204 detects the sheet P when the power supply is restored. In such a case, control may be performed so that, by, when the power supply is interrupted, storing the following on the non-volatile memory: the power supply is interrupted before manual stapling is performed, the postprocessing control unit 303 does not determine a sheet jam even if the sheet detection sensor 204 detects the sheet P when the power supply is restored from the interruption.

Hereinabove, according to this example, it is possible to improve usability obtained in a case where the power supply of the apparatus is interrupted and is restored again in a state in which a bundle of paper for manual stapling remains on the processing tray.

Note that, in S501 of FIG. 5 in this example, a process in which the postprocessing control unit 303 checks whether or not a predetermined time has elapsed from immediately preceding user operation on the basis of a result measured by the time measurement unit 308 may be added after the postprocessing control unit 303 determines that the postprocessing control unit 303 is under the manual stapling control. The immediately preceding user operation is a process in which the user places the sheet P on the stapling tray 32, and the predetermined time is a time period necessary for the user to place the sheet P on the stapling tray 32.

In a case where the predetermined time has not been elapsed from the user operation, there is a possibility that the bundle of paper is discharged while the user is touching the sheet P. Therefore, the postprocessing control unit 303 may implement the power-supply off process, without performing the discharge operation. Alternatively, the postprocessing control unit 303 may stand by until the predetermined time elapses, implement the discharge operation at a timing at which the predetermined time elapses, and thereafter implement the power-supply off process. In a case where the predetermined time has elapsed from the user operation, the postprocessing control unit 303 may proceed to the process in S502.

Further, in this example, the power supply button 309 is not necessarily a physical button and may be a virtual button displayed on a display or the like.

Example 2

In Example 1, there has been described operation performed in a case where an interruption instruction to interrupt the power supply of the image forming system is issued. In Example 2, there will be described operation performed in a case where the door 43 of the postprocessing apparatus 29 is opened in a state in which a bundle of paper for manual stapling remains on the processing tray. Description of a main part is similar to that in Example 1, and therefore only a part different from that in Example 1 will be described herein.

Figure 6:
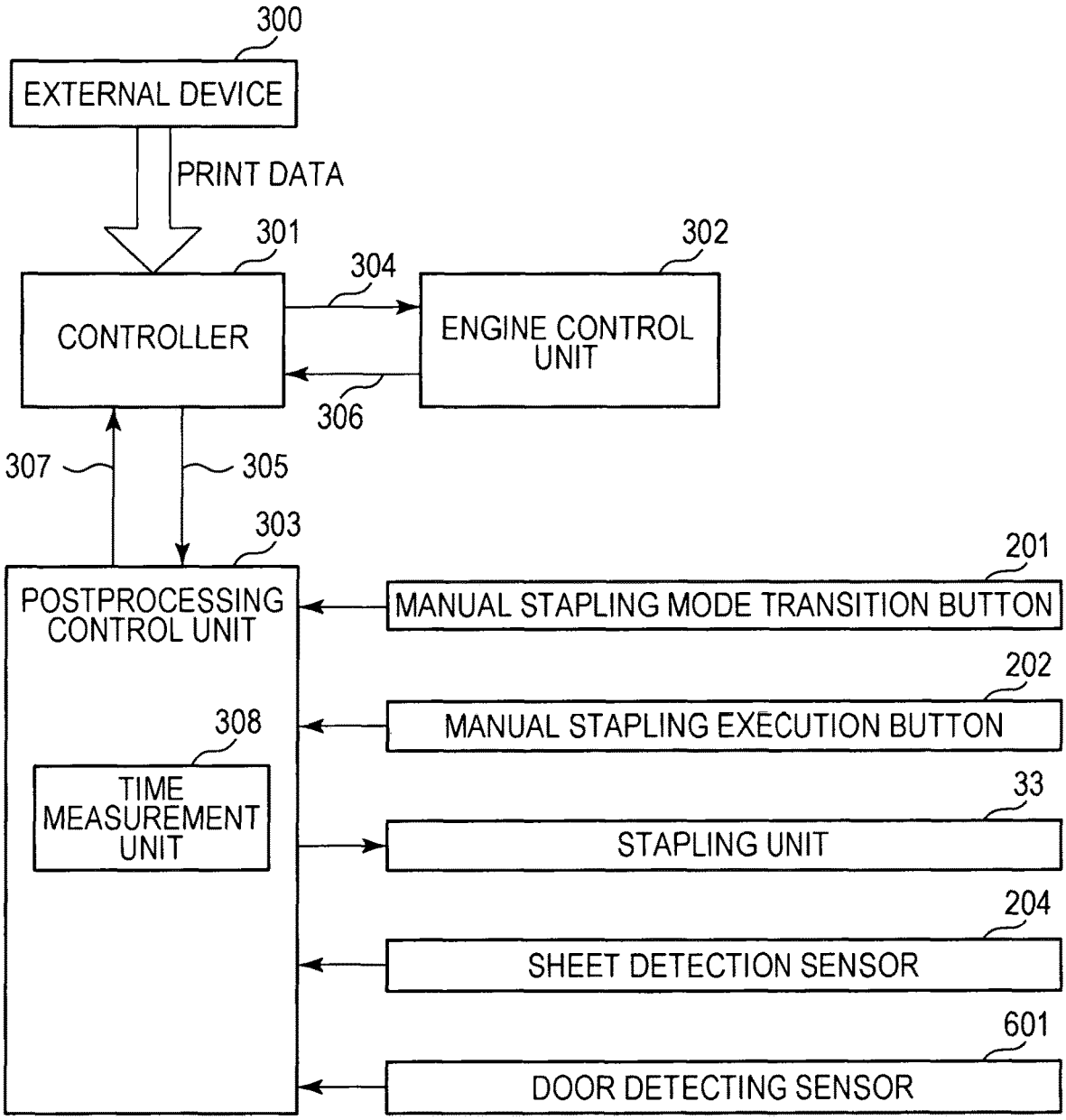
FIG. 6 is a control block diagram of an image forming system in Example 2.

FIG. 6 is a block diagram showing a system configuration of the image forming apparatus 101 and the postprocessing apparatus 29 in this example. A difference from Example 1 is that the postprocessing apparatus 29 includes a door detecting sensor 601. The door 43 is a component for exposing an inner structure of the postprocessing apparatus 29 and is used by the user to manually remove the sheet P in a case where a sheet jam occurs. An open/closed state of the door 43 is detected by the door detecting sensor 601. When the user opens the door 43 while the sheet P is being conveyed inside the postprocessing apparatus 29 and the door detecting sensor 601 detects opening of the door, the postprocessing control unit 303 stops all operation of the postprocessing apparatus 29.

Figure 7:
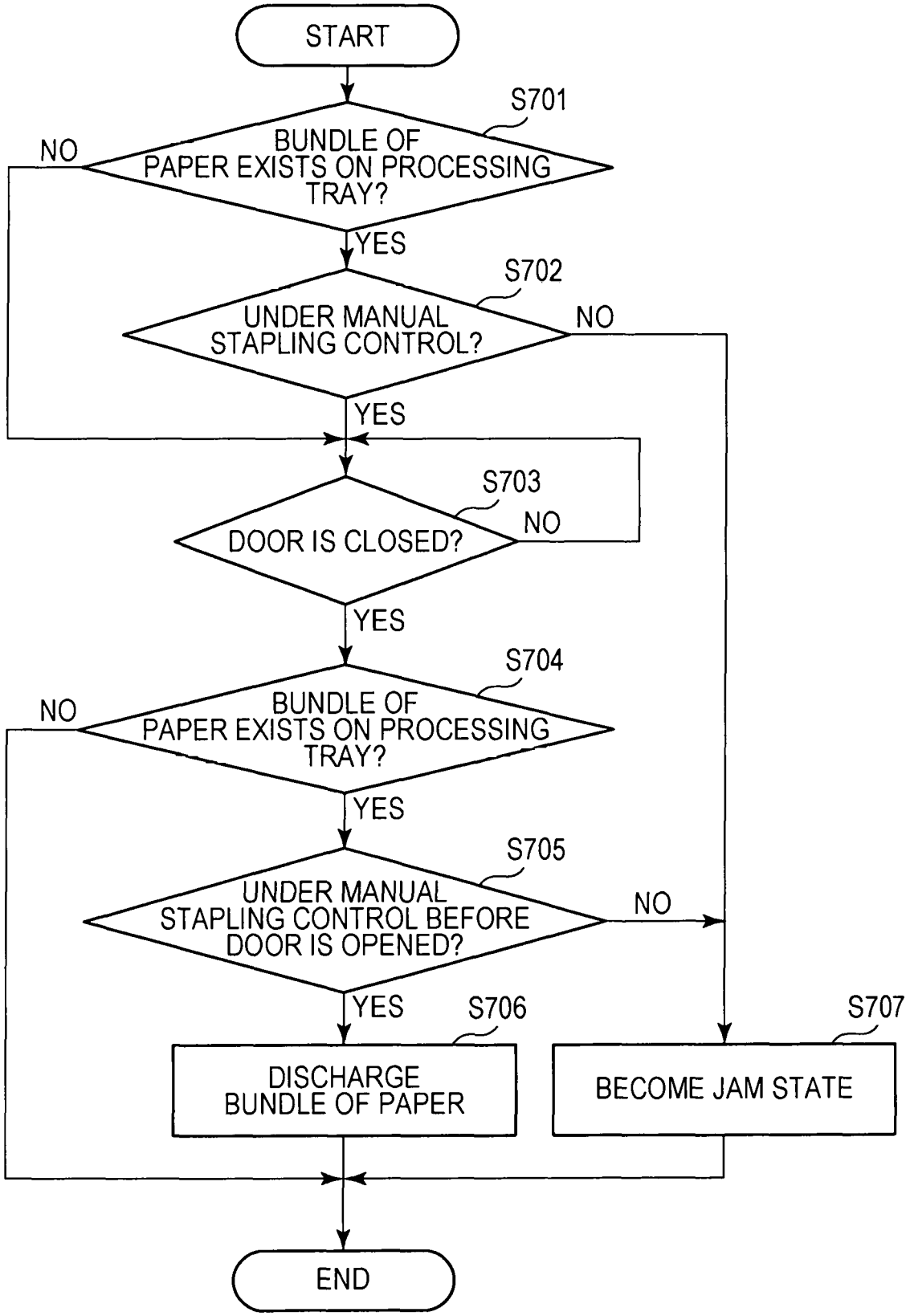
FIG. 7 is a flowchart showing operation of a postprocessing control unit in Example 2.

Hereinabove, in the configuration described above, operation of the postprocessing apparatus 29 in this example will be described with reference to a flowchart of FIG. 7. A start timing of this flow is a timing at which the door detecting sensor 601 detects opening of the door. Note that control based on FIG. 7 is mainly executed by the CPU 400 included in the postprocessing control unit 303 on the basis of a program stored on a ROM or the like (not shown).

First, the postprocessing control unit 303 determines whether or not the sheet P exists on the stapling tray 32 based on information of the sheet detection sensor 204 (S701). In a case where the postprocessing control unit 303 determines that no sheet P exists, the postprocessing control unit 303 waits until closing of the door is detected (S703). In a case where the postprocessing control unit 303 determines that the sheet P exists, the postprocessing control unit 303 checks whether or not the postprocessing control unit 303 has been under manual stapling control at the time of detecting opening of the door (S702). In a case where the postprocessing control unit 303 has not been under the manual stapling control, the postprocessing control unit 303 determines a sheet jam, becomes a sheet-jam state, and prompts the user to remove the sheet P (S707). In a case where the postprocessing control unit 303 has been under the manual stapling control, the postprocessing control unit 303 does not transmit notification of a sheet jam and waits until the door 43 is closed (S703).

Thereafter, in a case where the door detecting sensor 601 detects closing of the door, the postprocessing control unit 303 checks whether or not paper to be automatically output exists. First, the postprocessing control unit 303 determines whether or not the sheet P exists on the stapling tray 32 based on information of the sheet detection sensor 204 (S704). In a case where the postprocessing control unit 303 determines that no sheet P exists, the postprocessing control unit 303 determines that no paper to be automatically output exists and terminates the flow. In a case where the postprocessing control unit 303 determines that the sheet P exists, the postprocessing control unit 303 checks whether or not the postprocessing control unit 303 has been under the manual stapling control before the door is opened (S705). In a case where the postprocessing control unit 303 has not been under the manual stapling control, the postprocessing control unit 303 determines a sheet jam, becomes a sheet jam state, and prompts the user to remove the sheet P (S707). In a case where the postprocessing control unit 303 has been under the manual stapling control, the postprocessing control unit 303 determines that paper to be automatically output exists and implements discharge operation of a bundle of paper (S706). After the bundle of paper is discharged, the postprocessing control unit 303 terminates the flow.

Hereinabove, according to this example, it is possible to improve usability obtained in a case where the door 43 of the postprocessing apparatus 29 is opened in a state in which a bundle of paper for manual stapling remains on the processing tray.

Note that a case where the door 43 provided in the postprocessing apparatus 29 is opened has been described in this example, but the present disclosure is not limited thereto. The control in this example may be applied to a case where a door (not shown) provided in the image forming apparatus 101 is opened. In this case, the door detecting sensor 601 may be provided in the image forming apparatus 101, and the engine control unit 302 may be configured to receive a signal from the door detecting sensor 601. Then, the engine control unit 302 may notify the postprocessing control unit 303 that the door of the image forming apparatus 101 has been opened, and the postprocessing control unit 303 may stop operation of the postprocessing apparatus 29.

Further, in Examples 1 and 2 described above, the transition button 201 and the execution button 202 do not need to be provided in the postprocessing apparatus 29 and may be provided in the image forming apparatus 101. Further, the transition button 201 and the execution button 202 do not need to be physical buttons shown in FIG. 2 and may be virtual buttons displayed on a display or the like.

Further, in Examples 1 and 2 described above, a unit that switches an operating mode of the postprocessing apparatus 29, such as the transition button 201, does not need to be provided in the postprocessing apparatus 29, and, for example, the operating mode of the postprocessing apparatus 29 may be switched by using the external device 300.

Further, although an exemplary laser beam printer has been described in Examples 1 and 2 described above, an image forming apparatus to which the present disclosure is applied is not limited thereto and may be a printer of another printing method, such as an inkjet printer, or a copier.

According to the present disclosure, it is possible to improve usability obtained in a case where, in a state in which recording material is left on a processing tray, a power supply of an apparatus is interrupted and is restored again or a door of an apparatus is opened and is closed again.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-224156, filed Nov. 29, 2018, which is hereby incorporated by reference herein in its entirety.

What is claimed is:

1. An image forming system comprising:

an image forming unit configured to form an image on recording material;

a processing tray on which the recording material, having the formed image, is to be placed;

a recording material detecting unit configured to detect the recording material placed on the processing tray;

a stapling unit configured to execute a stapling process with respect to the recording material placed on the processing tray;

a discharge unit configured to discharge, from the processing tray via a discharge port, the recording material subjected to the stapling process by the stapling unit;

a discharge tray configured to receive the recording material discharged by the discharge unit;

an instruction unit configured to issue an execution instruction to instruct the stapling unit to execute the stapling process; and a control unit configured to control switching a mode between a first mode and a second mode, wherein the first mode is a mode in which the stapling process is executed with respect to the recording material conveyed from the image forming unit to the processing tray, and the second mode is a mode in which the stapling unit stands by the execution instruction from the instruction unit in a state in which the recording material detecting unit detects the recording material inserted into the processing tray from outside of a main body of the recording material detecting unit via the discharge port and, upon receipt of the execution instruction, executes the stapling process, wherein, in a case where the control unit receives an interruption instruction to interrupt a power supply of the image forming system in a state in which the recording material detecting unit detects the recording material inserted into the processing tray and the stapling unit stands by the execution instruction in the second mode, the control unit causes the discharge unit to execute discharge operation for discharging the recording material inserted into the processing tray to the discharge tray without causing the stapling unit to execute the stapling process with respect to the recording material inserted into the processing tray, and then interrupts the power supply.

2. The image forming system according to claim 1, wherein, in a case where the control unit receives the interruption instruction before a first predetermined time elapses since the recording material detecting unit detects the recording material inserted into the processing tray, the control unit interrupts the power supply without causing the discharge unit to execute the discharge operation.

3. The image forming system according to claim 1, wherein, in a case where the control unit receives the interruption instruction before a first predetermined time elapses since the recording material detecting unit detects the recording material inserted into the processing tray, the control unit stands by until the first predetermined time elapses, causes the discharge unit to execute the discharge operation, and then interrupts the power supply.

4. The image forming system according to claim 1, wherein, in a case where the recording material detecting unit does not detect the recording material placed on the processing tray even when a second predetermined time elapses from switching to the second mode, the control unit switches to the first mode.

5. The image forming system according to claim 1, wherein the discharge unit is a roller movable between a contact position and a separated position, wherein the contact position is a position at which the roller is brought into contact with the recording material placed on the processing tray, and the separated position is a position at which the roller is separated from the recording material placed on the processing tray, and wherein the control unit moves the roller to the contact position in a case where the mode is switched to the first mode and moves the roller to the separated position in a case where the mode is switched to the second mode.

6. The image forming system according to claim 5, wherein, in a case where the control unit causes the roller to execute the discharge operation in a state in which the mode is switched to the second mode and the roller is positioned at the separated position, the control unit moves the roller positioned at the separated position to the contact position.

7. An image forming system comprising:

an image forming unit configured to form an image on recording material;

a processing tray on which the recording material, having the formed image, is to be placed;

a recording material detecting unit configured to detect the recording material placed on the processing tray;

a stapling unit configured to execute a stapling process with respect to the recording material placed on the processing tray;

a discharge unit configured to discharge, from the processing tray via a discharge port, the recording material subjected to the stapling process by the stapling unit; and a control unit configured to perform control, wherein, in a state in which the recording material detecting unit detects the recording material inserted into the processing tray from outside of a main body of the recording material detecting unit via the discharge port, the control unit performs control so that the stapling unit executes the stapling process, wherein, in a case where the control unit receives an interruption instruction to interrupt a power supply of the image forming system in a state in which the recording material detecting unit detects the recording material, before the stapling process is performed, the control unit interrupts the power supply without causing the stapling unit to execute the stapling process, and wherein, in a case where the power supply of the image forming system is restored from the interruption, the control unit does not determine that a paper jam occurs even in a case where the recording material detecting unit detects the recording material.

8. The image forming system according to claim 7, wherein, in a case where the control unit interrupts the power supply of the image forming system, the control unit stores information on a storage unit, and wherein the information stored on the storage unit is information that, in the state in which the recording material detecting unit detects the recording material, the power supply is interrupted before the stapling process is performed.

9. An image forming system comprising:

an image forming unit configured to form an image on recording material;

a processing tray on which the recording material, having the formed image, is to be placed;

a recording material detecting unit configured to detect the recording material placed on the processing tray;

a stapling unit configured to execute a stapling process with respect to the recording material placed on the processing tray;

a discharge unit configured to discharge, from the processing tray via a discharge port, the recording material subjected to the stapling process by the stapling unit; and a control unit configured to perform control, wherein the control unit performs control so that the stapling unit executes the stapling process in a state in which the recording material detecting unit detects the recording material inserted into the processing tray from outside of a main body of the recording material detecting unit via the discharge port, and wherein, in a case where a power supply of the image forming system is interrupted and is restored in a state in which the recording material is detected by the recording material detecting unit and before the stapling process is executed, the control unit does not determine that a paper jam occurs even in a case where the recording material detecting unit detects the recording material.

10. The image forming system according to claim 9, wherein, in a case where the control unit interrupts the power supply of the image forming system, the control unit stores information on a storage unit, and wherein the information stored on the storage unit is information that, in the state in which the recording material detecting unit detects the recording material, the power supply is interrupted before the stapling process is performed.

* * * * *